US010967415B2

(12) United States Patent
Saha et al.

(10) Patent No.: US 10,967,415 B2
(45) Date of Patent: Apr. 6, 2021

(54) ELECTROMAGNETIC FIELD SHAPING SYSTEM AND METHOD

(71) Applicant: The Boeing Company, Chicago, IL (US)

(72) Inventors: Pradip K. Saha, Bellevue, WA (US); Mark E. Bice, Renton, WA (US); Gary Robert Weber, Kent, WA (US)

(73) Assignee: The Boeing Company, Chicago, IL (US)

( * ) Notice: Subject to any disclaimer, the term of this patent is extended or adjusted under 35 U.S.C. 154(b) by 649 days.

(21) Appl. No.: 15/602,583

(22) Filed: May 23, 2017

(65) Prior Publication Data

US 2018/0339331 A1 Nov. 29, 2018

(51) Int. Cl.

| | |
|---|---|
| ***B21D 26/14*** | (2006.01) |
| ***B21D 11/18*** | (2006.01) |
| ***B21D 53/92*** | (2006.01) |

(52) U.S. Cl.

CPC ..... *B21D 26/14* (2013.01); *B21D 11/18* (2013.01); *B21D 53/92* (2013.01)

(58) Field of Classification Search

CPC ..... B21D 26/06; B21D 26/14; B21D 11/18; B21D 37/02; Y10T 29/79803

USPC ..... 72/56, 60, 62

See application file for complete search history.

(56) References Cited

U.S. PATENT DOCUMENTS

| | | | | |
|---|---|---|---|---|
| 5,176,019 | A | 1/1993 | Brooks, Jr. | |
| 5,419,171 | A | 5/1995 | Bumgarner | |
| 6,050,121 | A | 4/2000 | Daehn et al. | |
| 6,575,008 | B1 * | 6/2003 | Huhtala | B21D 7/06 72/369 |
| 2010/0139070 | A1 * | 6/2010 | Cheng | B21D 26/14 29/419.2 |
| 2013/0133389 | A1 * | 5/2013 | Koo | B21D 26/14 72/60 |
| 2017/0297077 | A1 * | 10/2017 | Dykstra | B29C 51/42 |

FOREIGN PATENT DOCUMENTS

| | | | |
|---|---|---|---|
| CN | 1655890 | A | 8/2005 |
| CN | 101869940 | A | 10/2010 |
| GB | 1115323 | A | 5/1968 |

OTHER PUBLICATIONS

Tan et al., "Guideline for Forming Stiffened Panels by Using the Electromagnetic Forces," Metals 2016, vol. 6, Issue 11, No. 267, 24 pages.

Chinese Office Action and English translation, dated Sep. 25, 2020, regarding Application No. 2018104239166, 16 pages.

* cited by examiner

*Primary Examiner* — Debra M Sullivan

(74) *Attorney, Agent, or Firm* — Yee & Associates, P.C.

(57) ABSTRACT

A method, system, and apparatus for a part forming system. The part forming system comprises a field shaper having a cavity configured to receive a workpiece and a die. The field shaper has a number of dimensions based on being inserted into a main coil. The workpiece is bent to form a part with a desired shape when an electromagnetic field from the main coil is applied to the field shaper while the field shaper is located within the main coil.

20 Claims, 14 Drawing Sheets

ELECTROMAGNETIC FIELD SHAPING SYSTEM AND METHOD

BACKGROUND INFORMATION

1. Field

The present disclosure relates generally to manufacturing parts, and in particular, to manufacturing parts using an electromagnetic field shaping system for metalworking.

2. Background

Metalworking is a process of shaping metal materials to manufacture parts, assemblies, or structures. For example, forming processes may be used to form a part with a desired shape by deforming a workpiece. The workpiece is an initial piece of metal that is processed to form the part.

In forming parts, a press and a die may be used to bend a workpiece to form a part with a desired shape. For example, a workpiece, such as stringer for an aircraft, may be placed on a die in a press. The press applies a force on the stringer to form joggle bends in the stringer. These bends are formed such that flanges of the stringer follow the surface of a structure on which the stringer is to be attached. For example, steps or curves may be present on the surface of the mating structure and the bends are made to follow the steps or curves.

Forming joggles in stringers using presses with dies is a time-consuming process in manufacturing an aircraft. Currently used processes for forming joggle bends in stringers may involve higher temperatures than desired. Issues with spring back or die geometries also may occur where the materials in the stringers may be more elastic than intended. In other words, the joggle bends formed in the stringer may not maintain the desired shape to follow the surface of the structure in which the stringer is to be attached.

Therefore, it would be desirable to have a method and apparatus that take into account at least some of the issues discussed above, as well as other possible issues. For example, it would be desirable to have a method and apparatus that overcome a technical problem with forming joggle bends in a stringer.

SUMMARY

An embodiment of the present disclosure provides a part forming system. The part forming system comprises a field shaper that has a cavity configured to receive a workpiece and a die. The field shaper has a number of dimensions based on being inserted into a main coil. The workpiece is bent to form a part with a desired shape when an electromagnetic field from the main coil is applied to the field shaper while the field shaper is located within the main coil.

Another embodiment of the present disclosure provides a part forming system for forming joggle bends in a workpiece. The part forming system comprises a main coil, a joggle die, and a field shaper. The field shaper has a cavity configured to receive the workpiece and the joggle die. The field shaper has a number of dimensions based on a number of dimensions of the main coil. The joggle bends are formed in the workpiece to form a part with a desired shape when an electromagnetic field from the main coil is applied to the field shaper while the field shaper is located within the main coil.

Yet another embodiment of the present disclosure provides a method for forming a part. The method comprises placing a workpiece into a cavity of a field shaper. The method applies an electromagnetic field to the field shaper from a main coil located around the field shaper. The electromagnetic field causes a magnetic pressure that bends the workpiece on a die into a desired shape for the part.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account one or more different considerations. For example, the illustrative embodiments recognize and take into account that bending workpieces with higher velocities or strain-rates and at ambient or lower temperatures may reduce issues with spring back. For example, the illustrative embodiments recognize and take in account that bending a workpiece at an ambient temperature and with higher velocities or strain-rates may lead to increased formability of the workpiece material.

The illustrative embodiments recognize and take into account that the workpiece may better retain the desired shape under these conditions, resulting in increased consistency and reproducible product quality. The illustrative embodiments recognize and take account that the situation may allow for a higher rate of production without the need for raised temperatures, lubrication, or space needed for forming parts using additional presses.

Thus, the illustrative embodiments provide a method and apparatus for forming a part. In one illustrative example, a workpiece is placed into a cavity of a field shaper. An electromagnetic field is applied to the field shaper from a main coil located around the field shaper. The electromagnetic field causes a number of forces that bends the workpiece on a die into a desired shape for the part.

As used herein, a "number of," when used with reference to items, means one or more items. For example, a number of forces is one or more forces.

Figure 1:
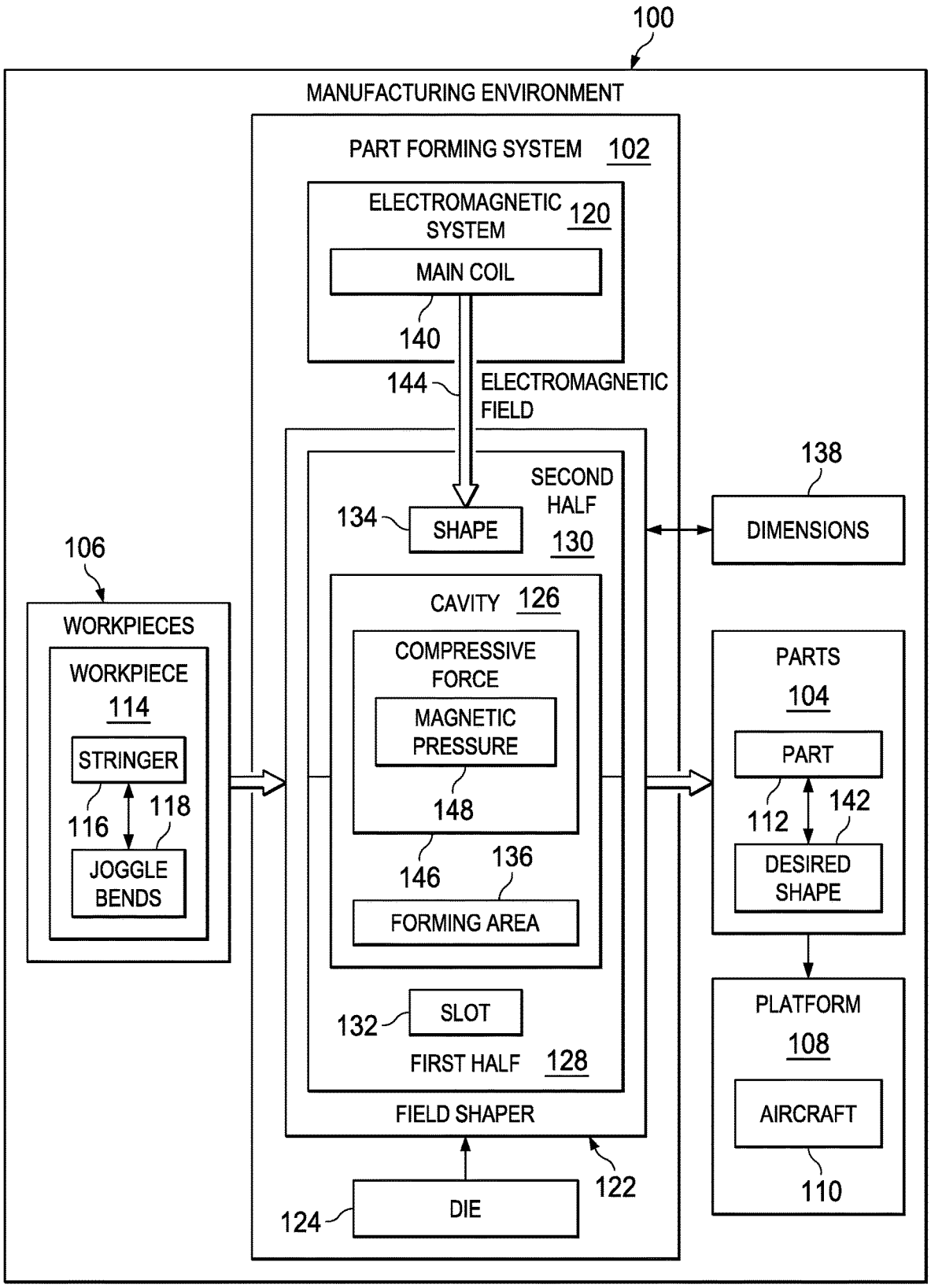
FIG. 1 is an illustration of a block diagram of a manufacturing environment in accordance with an illustrative embodiment.

With reference now to the figures, and in particular with reference to FIG. 1, an illustration of a block diagram of a manufacturing environment is depicted in accordance with an illustrative embodiment. As depicted, manufacturing environment 100 includes part forming system 102. Part forming system 102 is used to manufacture parts 104 from workpieces 106. In these illustrative examples, parts 104 are used to assemble platform 108. In this illustrative example, platform 108 takes the form of aircraft 110.

As depicted, part 112 in parts 104 may be formed from workpiece 114 in workpieces 106. Workpiece 114 comprises at least one of a conductive material, a metal alloy, a nickel alloy, aluminum, steel, carbon steel, copper, brass, silver, iron, titanium, or some other suitable material.

In this example, workpiece 114 is shaped to form part 112. Part 112 is selected from one of a stringer, a fuselage stringer, an aircraft stringer, an intercostal, a hydraulic reservoir, a cleat, a duct, a shaped frame, a shear tie, or some other suitable type of part.

In one illustrative example, workpiece 114 is shaped by bending workpiece 114 to form part 112. For example, workpiece 114 may be stringer 116, and joggle bends 118 may be formed in stringer 116 by bending stringer 116 to form part 112.

As depicted, the shaping of workpiece 114 may be performed using part forming system 102. In this illustrative example, part forming system 102 comprises electromagnetic system 120, field shaper 122, and die 124.

Die 124 is a tool associated with field shaper 122. When one component is "associated" with another component, the association is a physical association. For example, a first component, die 124, may be considered to be physically associated with a second component, field shaper 122, by at least one of being secured to the second component, bonded to the second component, mounted to the second component, welded to the second component, fastened to the second component, or connected to the second component in some other suitable manner. The first component also may be connected to the second component using a third component. The first component may be considered to be physically associated with the second component by being formed as part of the second component, an extension of the second component, or both.

In this depicted example, die 124 may be placed within cavity 126 in field shaper 122 or connected to field shaper 122 within cavity 126 when associated with field shaper 122. As another example, die 124 may be formed as part of field shaper 122 rather than as a separate component.

As depicted, cavity 126 in field shaper 122 is configured to receive workpiece 114 and die 124. As depicted, die 124 is placed inside cavity 126 of field shaper 122. In this example, workpiece 114 is placed over die 124 within cavity 126 in field shaper 122.

Die 124 may take various forms. For example, when joggle bends 118 are formed in workpiece 114, die 124 may be selected from a group of dies consisting of a joggle die, an offset joggle die, and a crush joggle die. If other shapes are desired other than joggle bends 118, die 124 may take other forms. When die 124 is a type of joggle die, part 112 may be a stringer for an aircraft.

In this illustrative example, field shaper 122 has first half 128 and second half 130. First half 128 has slot 132 that receives die 124. Second half 130 has shape 134 that receives workpiece 114 placed on die 124 when first half 128 and second half 130 are joined to define cavity 126.

The location of workpiece 114 within cavity 126 on die 124 is forming area 136. Forming area 136 may have three dimensions.

Field shaper 122 has a number of dimensions 138 in which dimensions 138 are based, at least in part, on being inserted into main coil 140 in electromagnetic system 120. For example, the number of dimensions 138 may be selected based on a size of main coil 140. As depicted, the number of dimensions 138 are selected from at least one of a height of the field shaper, a length of the field shaper, a length of a forming area, a height of the forming area, or some other suitable parameter.

In the illustrative examples, field shaper 122 has a cylindrical shape. In other words, field shaper 122 has a cross-section in the form of a circle. In other illustrative examples, the cross-section may take a form such as a square, a pentagon, an octagon, an icosagon, or some other suitable shape.

As used herein, the phrase "at least one of", when used with a list of items, means different combinations of one or more of the listed items may be used, and only one of each item in the list may be needed. In other words, "at least one of" means any combination of items and number of items may be used from the list, but not all of the items in the list are required. The item may be a particular object, a thing, or a category.

For example, without limitation, "at least one of item A, item B, or item C" may include item A, item A and item B, or item B. This example also may include item A, item B, and item C; or item B and item C. Of course, any combinations of these items may be present. In some illustrative examples, "at least one of" may be, for example, without limitation, two of item A, one of item B, and ten of item C; four of item B and seven of item C; or other suitable combinations.

Workpiece 114 is bent to form part 112 with desired shape 142 when electromagnetic field 144 from main coil 140 is applied to field shaper 122 while field shaper 122 is located within main coil 140. In this illustrative example, opposing magnetic pressure is created from two induced electromagnetic fields. These fields include one field from main coil 140 to field shaper 122 and another field from field shaper 122 to workpieces 106 while field shaper 122 is located within main coil 140.

In this illustrative example, electromagnetic system 120 has main coil 140 that is configured to receive field shaper 122 with workpiece 114. Main coil 140 causes compressive force 146 on workpiece 114 on die 124 to form part 112. As depicted, main coil 140 may generate electromagnetic field 144 that causes compressive force 146 in the form of magnetic pressure 148. Magnetic pressure 148 is a force over an area of the surface of workpiece 114 that is located within forming area 136 within cavity 126 of field shaper 122 in this illustrative example.

In one illustrative example, one or more technical solutions are present that overcome a technical problem with forming joggle bends in a stringer. One or more technical solutions include a field shaper that is designed to fit within a coil that generates an electromagnetic field while the field shaper holds a workpiece within a cavity of the field shaper. As a result, one or more technical solutions may provide a technical effect of forming joggle bends in a workpiece, such as a stringer, to form a part in the form of a stringer with joggle bends. One or more technical solutions provide a technical effect of reducing spring back on features formed with bends such as flanges, joggle bends, or other features on the part.

The illustration of manufacturing environment 100 in FIG. 1 is not meant to imply physical or architectural limitations to the manner in which an illustrative embodiment may be implemented. Other components, in addition to or in place of the ones illustrated, may be used. Some components may be unnecessary. Also, the blocks are presented to illustrate some functional components. One or more of these blocks may be combined, divided, or combined and divided into different blocks when implemented in an illustrative embodiment.

For example, platform 108 may take other forms other than aircraft 110. In the illustrative examples, platform 108 may be selected from, for example, a mobile platform, a stationary platform, a land-based structure, an aquatic-based structure, and a space-based structure. More specifically, platform 108 may be a surface ship, a tank, a personnel carrier, a train, a spacecraft, a space station, a satellite, a submarine, an automobile, a power plant, a bridge, a dam, a house, a manufacturing facility, a building, and other suitable platforms, in addition to or in place of aircraft 110.

As another example, the shaping of workpiece 114 may be made in conjunction with other processes. For example, inductive heating may be performed on workpiece 114 prior to shaping workpiece 114 using field shaper 122 within main coil 140 in electromagnetic system 120.

Figure 2:
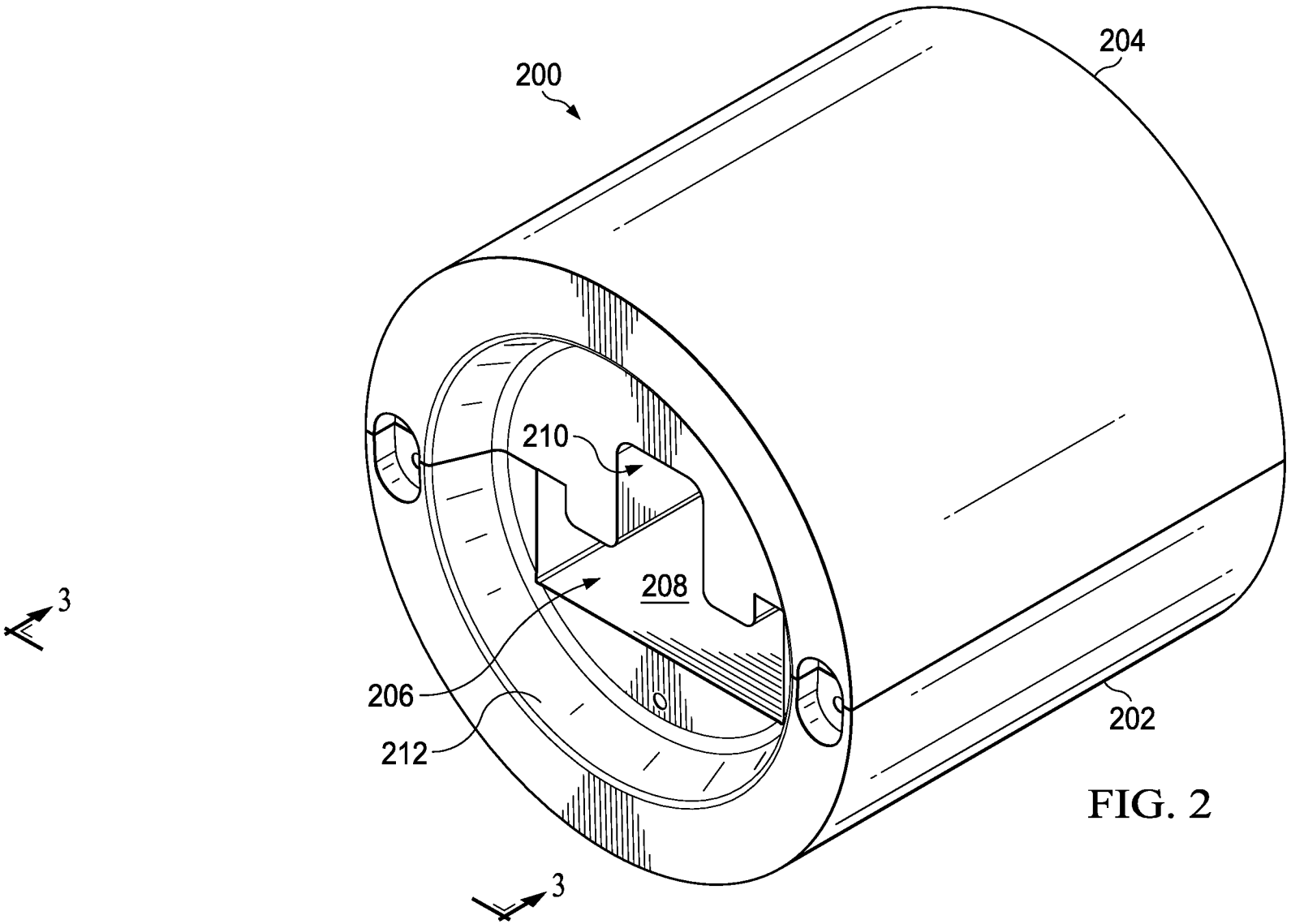
FIG. 2 is an illustration of a field shaper in accordance with an illustrative embodiment.

With reference now to FIG. 2, an illustration of a field shaper is depicted in accordance with an illustrative embodiment. In this illustrative example, field shaper 200 is an example of one implementation of field shaper 122 shown in block form in FIG. 1.

In this example, field shaper 200 is shown with two parts, first half 202 and second half 204. Field shaper 200 has cavity 206 defined by slot 208 in first half 202 and slot 210 in second half 204.

In this illustrative example, relief 212 is present in field shaper 200. Relief 212 is circular in shape and is used to harness the unused available field pressure and focus it into a forming area, such as forming area 136 in FIG. 1.

Figure 3:
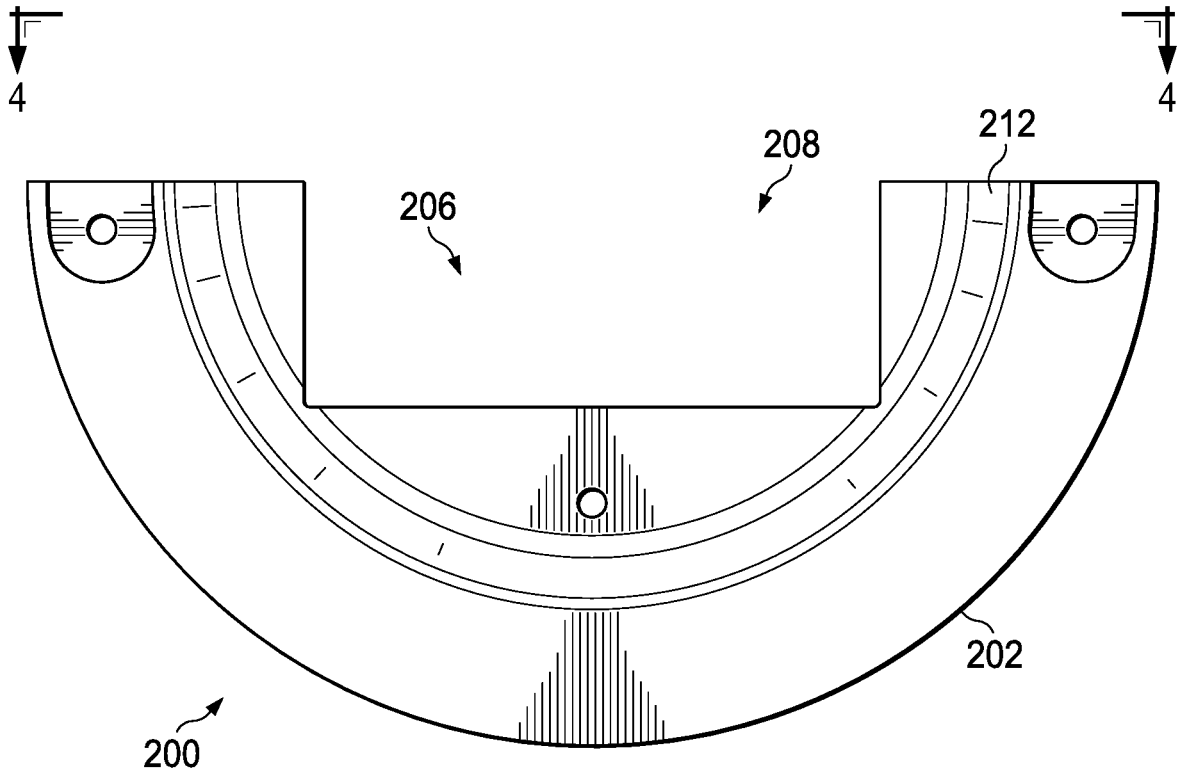
FIG. 3 is an illustration of an end of a first half of a field shaper in accordance with an illustrative embodiment.

Turning now to FIG. 3, an illustration of an end of a first half of a field shaper is depicted in accordance with an illustrative embodiment. In this example, first half 202 is shown in the direction of lines 3-3 in FIG. 2.

Figure 4:
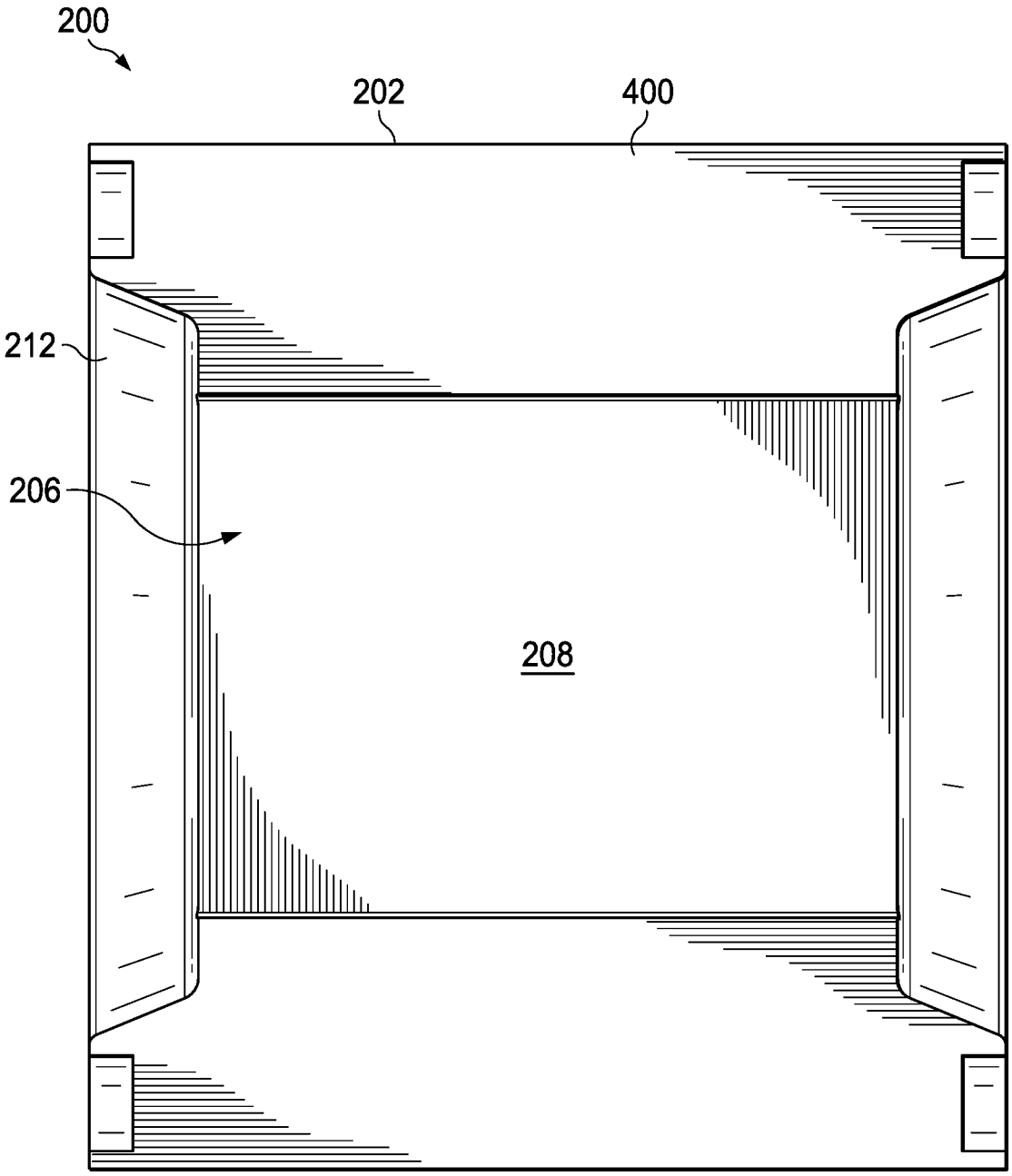
FIG. 4 is an illustration of an interior side of a first half of a field shaper in accordance with an illustrative embodiment.

Turning now to FIG. 4, an illustration of an interior side of a first half of a field shaper is depicted in accordance with an illustrative embodiment. In this example, interior side 400 of first half 202 of field shaper 200 is show in the direction of lines 4-4 in FIG. 3.

Figure 5:
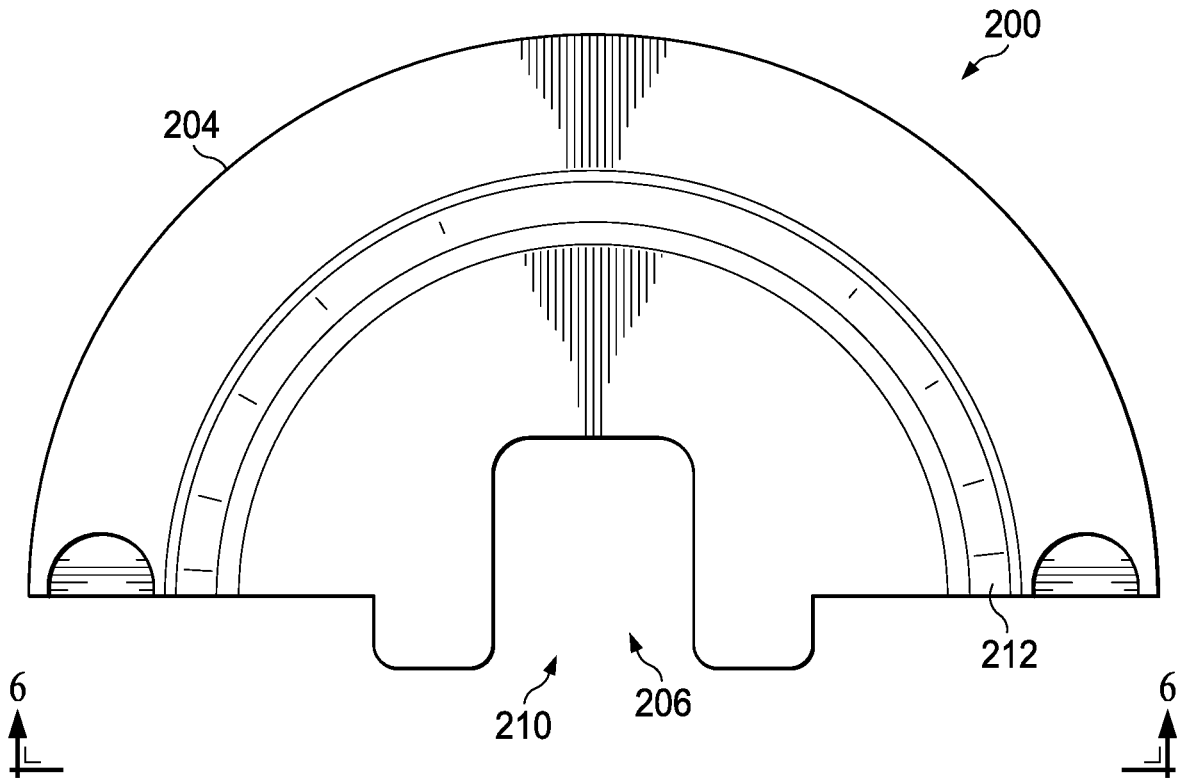
FIG. 5 is an illustration of an end of a second half of a field shaper in accordance with an illustrative embodiment.

Turning now to FIG. 5, an illustration of an end of a second half of a field shaper is depicted in accordance with an illustrative embodiment. In this example, second half 204 of field shaper 200 is shown in the direction of lines 3-3 in FIG. 2.

Figure 6:
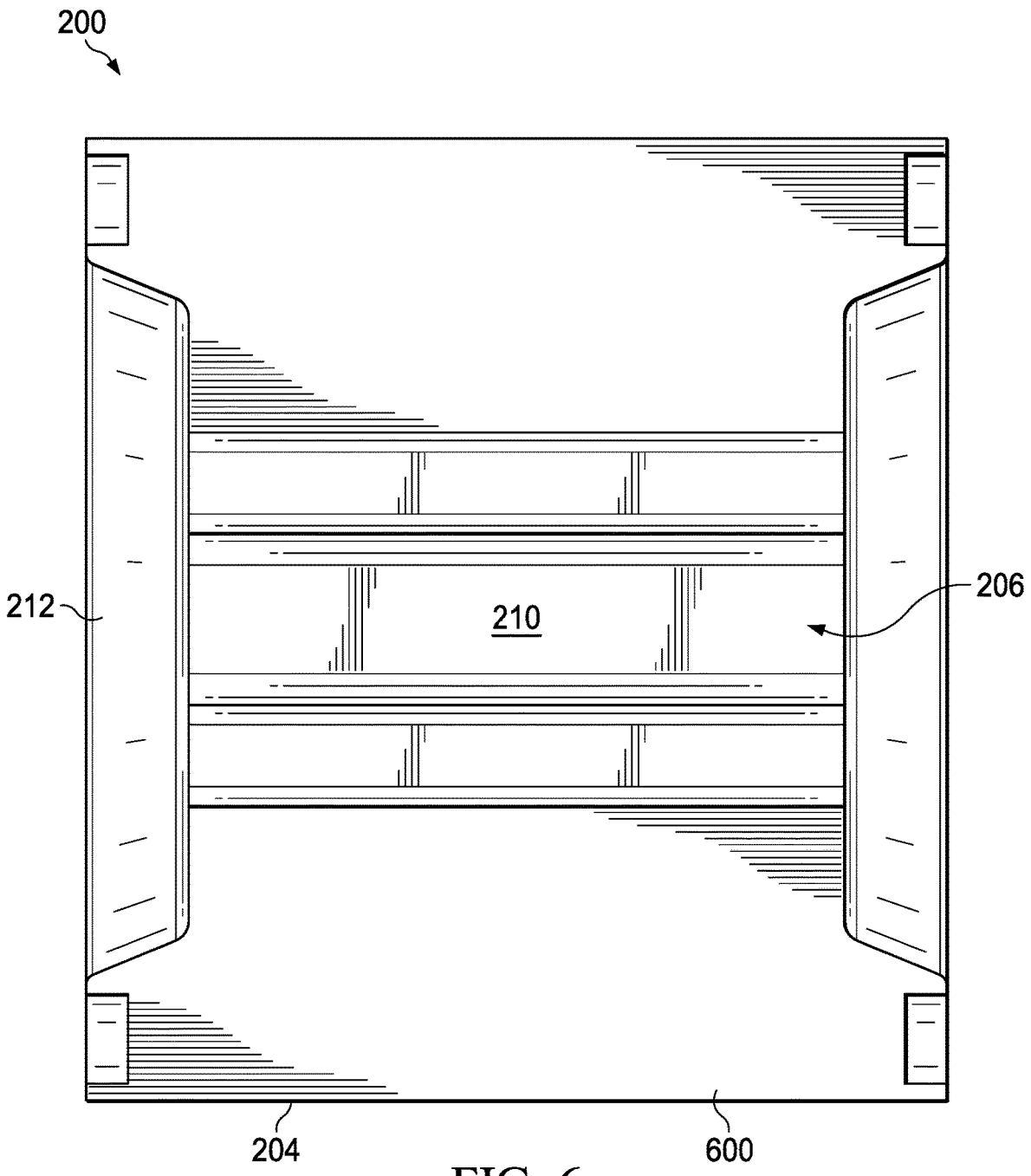
FIG. 6 is an illustration of an interior side of a second half of a field shaper in accordance with an illustrative embodiment.

Turning now to FIG. 6, an illustration of an interior side of a second half of a field shaper is depicted in accordance with an illustrative embodiment. In this example, interior side 600 of second half 204 of field shaper 200 is shown in the direction of lines 6-6 in FIG. 5.

Figure 7:
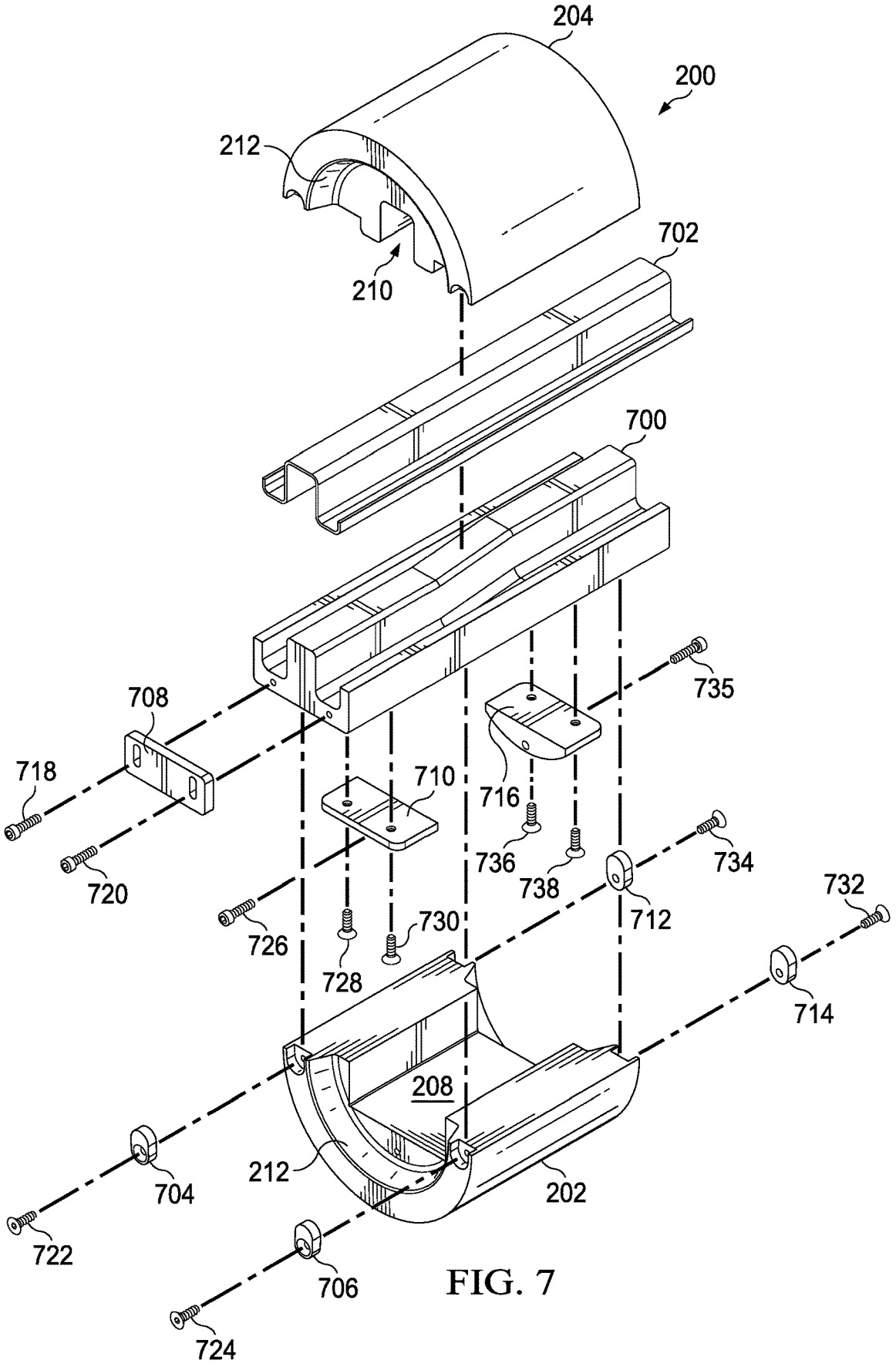
FIG. 7 is an illustration of an exploded view of a field shaper with a die and a workpiece in accordance with an illustrative embodiment.

With reference now to FIG. 7, an exploded view of a field shaper with a die and a workpiece is depicted in accordance with an illustrative embodiment. In this exploded view, die 700 and workpiece 702 are seen. Die 700 is an example of one physical implementation for die 124 shown in block form in FIG. 1. In this particular example, die 700 is an offset joggle die. Workpiece 702 is an example of a physical implementation for workpiece 114 shown in block form in FIG. 1. Workpiece 702 is a stringer in which joggle bends are to be formed.

As depicted, slot 208 in first half 202 is configured to receive and hold die 700. Slot 210 in second half 204 is configured to receive workpiece 702 such that workpiece 702 is positioned over die 700.

In this exploded view, end stop 704, end stop 706, end stop 708, die retainer 710, end stop 712, end stop 714, die retainer 716, fastener 718, fastener 720, fastener 722, fastener 724, fastener 726, fastener 728, fastener 730, fastener 732, fastener 734, fastener 735, fastener 736, and fastener 738 are shown for field shaper 200.

Figure 8:
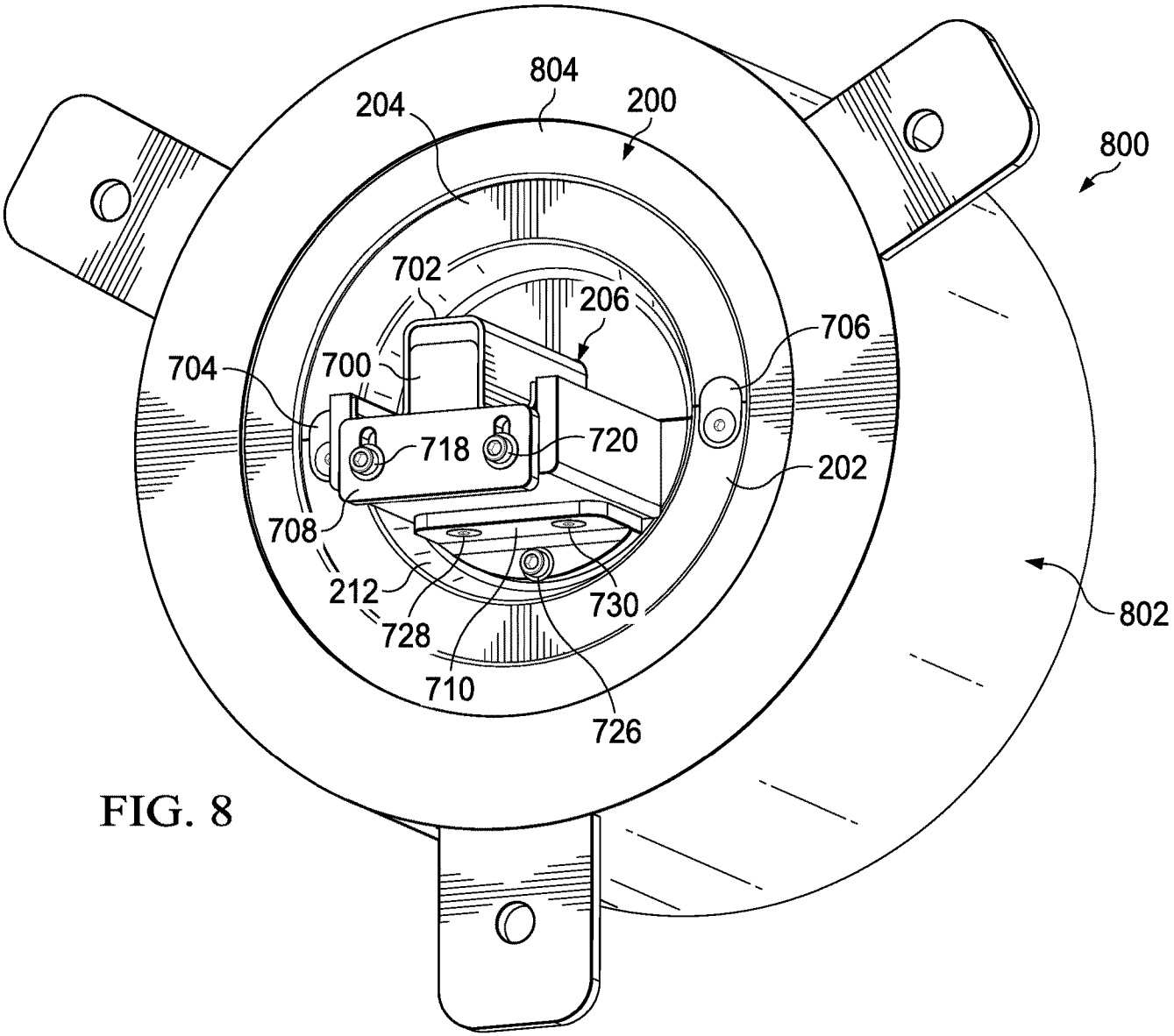
FIG. 8 is an illustration of a part forming system in accordance with an illustrative embodiment.

Turning now to FIG. 8, an illustration of a part forming system is depicted in accordance with an illustrative embodiment. Part forming system 800 is an example of one implementation of part forming system 102 shown in block form in FIG. 1. As depicted, part forming system 800 comprises electromagnetic system 802 that includes main coil 804. Part forming system 800 also includes field shaper 200 and die 700. In this illustrative example, die 700 is located within field shaper 200, and field shaper 200 is located within main coil 804 in electromagnetic system 802. As depicted, workpiece 702 is positioned within field shaper 200.

Figure 9:
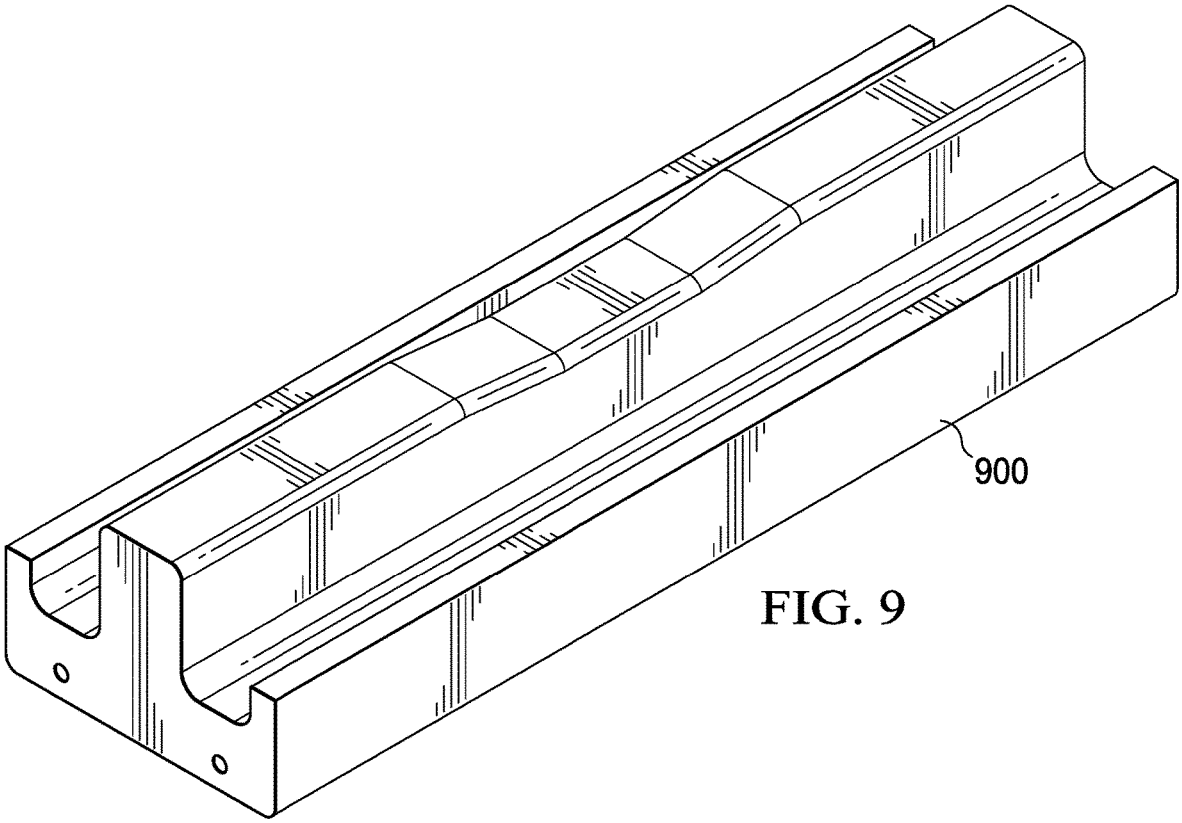
FIG. 9 is an illustration of a die in accordance with an illustrative embodiment.

With reference to FIG. 9, an illustration of a die is depicted in accordance with an illustrative embodiment. As depicted, crush joggle die 900 is an example of another die that may be used to implement die 124 shown in block form in FIG. 1. Crush joggle die 900 may be placed into slot 208 in place of die 700 in FIG. 7, in which die 700 is an offset joggle die in the depicted example.

Joggles are used where the central stringer flange that attaches to the fuselage skin is displaced to accommodate a disruption to the skin inner surface. These offsets may occur at the end of a fuselage section or around an opening, such as a door.

An offset joggle is where the entire cross-section is displaced. A crush joggle is where the two outer flanges remain planar with the outer flanges adjacent to the joggle but the central flange is displaced.

Figure 10:
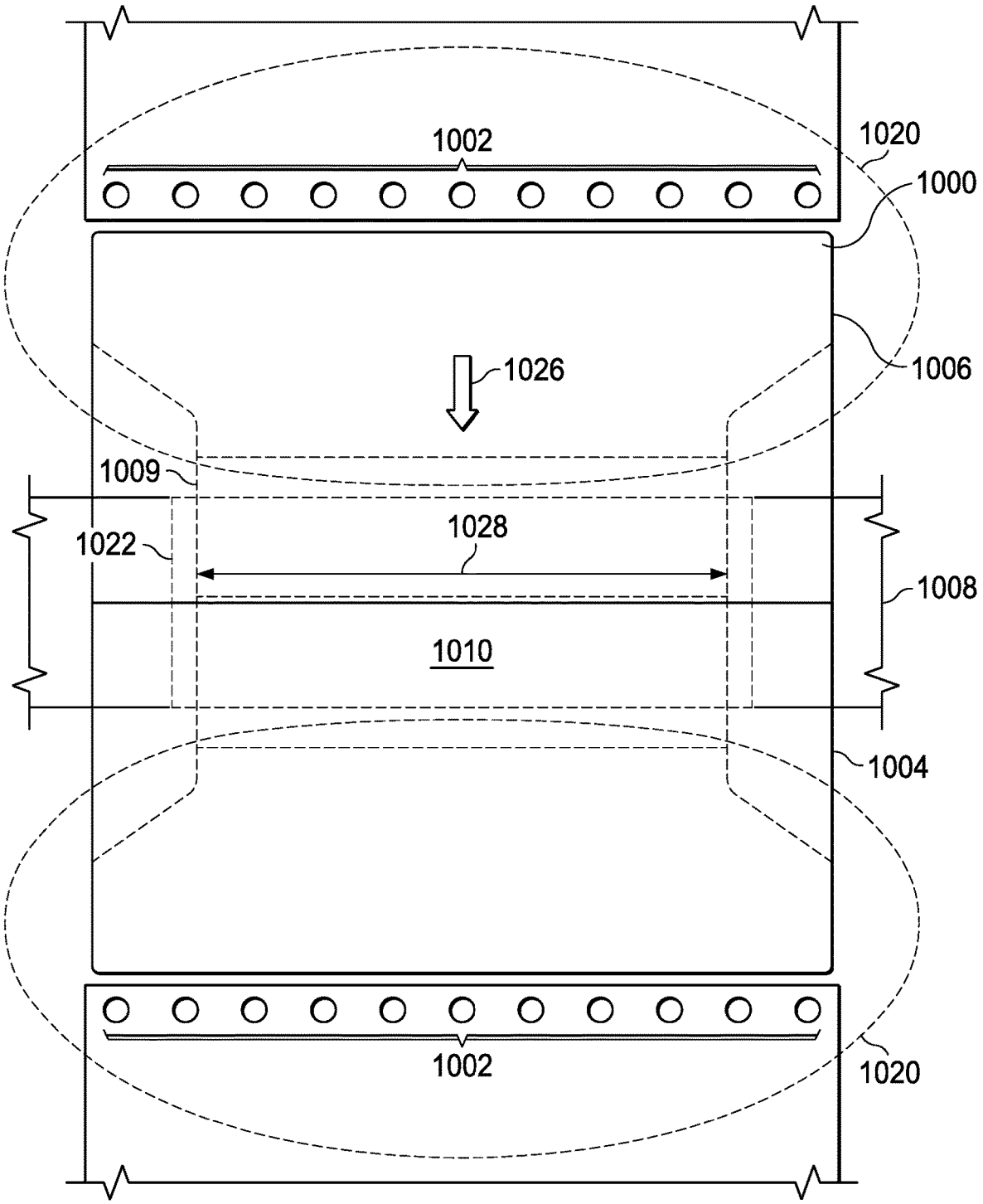
FIG. 10 is an illustration of fields generated by a coil and a field shaper in accordance with an illustrative embodiment.

Turning now to FIG. 10, an illustration of fields generated by a coil and a field shaper is depicted in accordance with an illustrative embodiment. In this illustrative example, field shaper 1000 is located within coil 1002. Field shaper 1000 and coil 1002 are examples of field shaper 122 and main coil 140 shown in block form in FIG. 1. Only a portion of coil 1002 is shown in this illustration to avoid obscuring the illustration of field shaper 1000 and different fields that may be generated.

Field shaper 1000 has first half 1004 and second half 1006. In this illustrative example, stringer 1008 is a workpiece and is located within cavity 1009 of field shaper 1000. Stringer 1008 is placed over die 1010

In this illustrative example, coil 1002 has field 1020 within field shaper 1000. Field 1022 is the field in stringer 1008 and die 1010. Field 1020 is the result of eddy currents within field shaper 1000, and field 1022 is the result of eddy currents within stringer 1008 and die 1010.

These magnetic fields result in magnetic pressure 1026 that causes bending of stringer 1008. Magnetic pressure 1026 forces stringer 1008 against die 1010 such that stringer 1008 bends to a desired shape. In this example, the desired shape is the forming of joggle bends in stringer 1008 along the joggle forming length 1028.

In other illustrative examples, other types of desired shapes may be generated by the selection of die 1010. The angle of the flanges may be designed to achieve multiple angles. Also, joggles may be bulged to increase their size in different location as needed.

Figure 11:
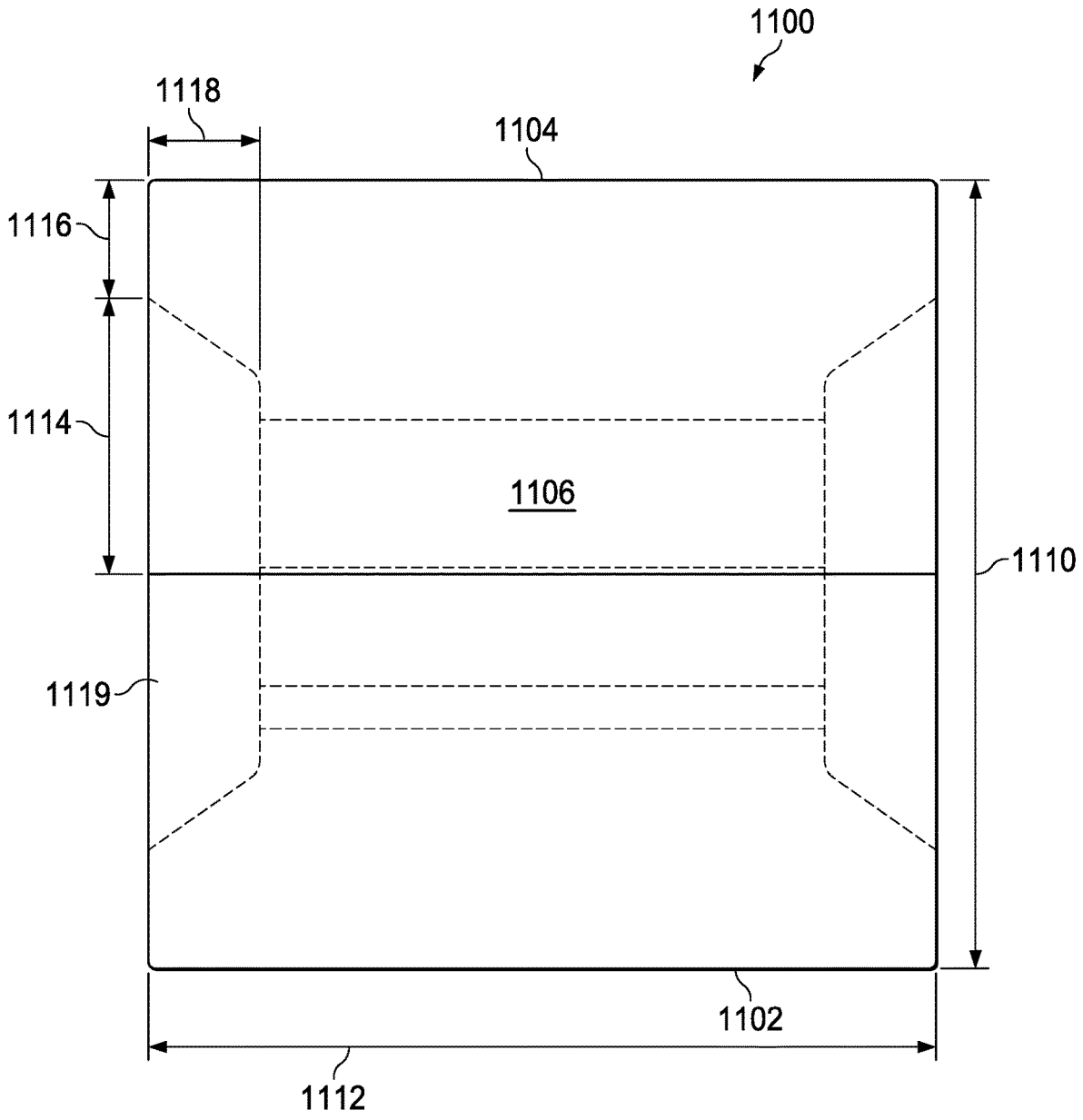
FIG. 11 is an illustration of a design of a field shaper in accordance with an illustrative embodiment.

With reference now to FIG. 11, an illustration of a design of a field shaper is depicted in accordance with an illustrative embodiment. In this illustrative example, field shaper 1100 is an example of one implementation for field shaper 122 shown in block form in FIG. 1.

As depicted, field shaper 1100 has first half 1102 and second half 1104. In typical use, first half 1102 is a lower half in which a die may be placed while second half 1104 is an upper half in which a workpiece may be received. A cavity is located within field shaper 1100 that contains forming area 1106. Forming area 1106 is an area in which a workpiece may be shaped within field shaper 1100.

In this illustrative example, field shaper 1100 has a number of different dimensions. These dimensions are examples of dimensions 138 in FIG. 1. The dimensions include diameter 1110, length 1112, setback 1114, flange width 1116, and relief depth 1118.

In this illustrative example, diameter 1110 is a diameter of field shaper 1100. Diameter 1110 may be selected such that field shaper 1100 has a desired fit within a coil.

As depicted, length 1112 is a length of field shaper 1100. Length 1112 may be selected based on the depth of the coil needed to have a desired forming range.

Setback 1114 is a setback from at least one of the surface of the die or the workpiece. Next, flange width 1116 is a flange width for a workpiece, such as a stringer. Relief depth 1118 is a relief depth for relief 1119 in field shaper 1100. In this illustrative example, relief depth 1118 controls the field dimension to control forming.

Length 1112 and relief depth 1118 are selected as follows:

$$\text{Field dimension}=\text{length}-2*\text{relief depth}.$$

These values are selected to concentrate the magnetic field in a desired manner to control forming of joggle bends along the length of the workpiece within forming area 1106. The field dimension is dependent on the shape and size of the parts being formed.

Figure 12:
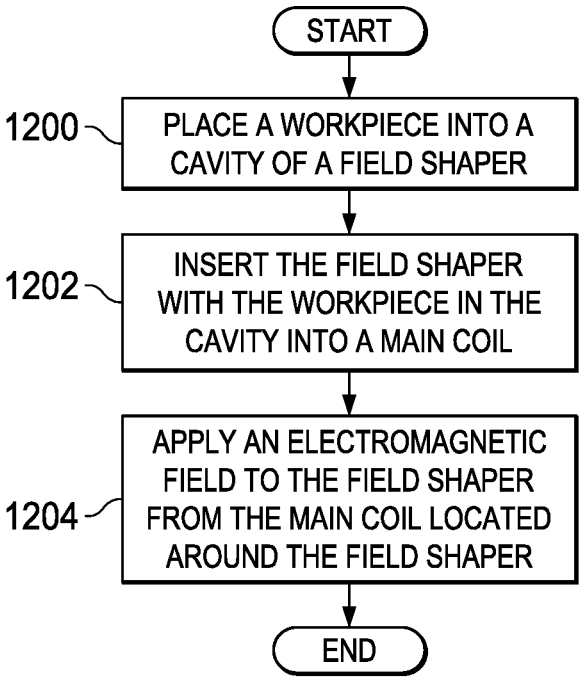
FIG. 12 is an illustration of a flowchart of a process for forming a part from a workpiece in accordance with an illustrative embodiment.

Turning next to FIG. 12, an illustrator of a flowchart of a process for forming a part from a workpiece is depicted in accordance with an illustrative embodiment. The process illustrated in FIG. 12 may be implemented using part forming system 102 in manufacturing environment 100 in FIG. 1.

The process begins by placing a workpiece into a cavity of a field shaper (operation 1200). In operation 1200, the field shaper includes an appropriate die in the cavity. The process inserts the field shaper with the workpiece in the cavity into a main coil (operation 1202).

The process then applies an electromagnetic field to the field shaper from the main coil located around the field shaper (operation 1204). The process terminates thereafter.

The electromagnetic field causes a magnetic pressure that bends the workpiece on a die into a desired shape for a part. The magnetic pressure is a compressive force on the workpiece that bends the workpiece into the desired shape for the part.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent at least one of a module, a segment, a function, or a portion of an operation or step. For example, one or more of the blocks may be implemented as program code, hardware, or a combination of program code and hardware. When implemented in hardware, the hardware may, for example, take the form of integrated circuits that are manufactured or configured to perform one or more operations in the flowcharts or block diagrams. When implemented as a combination of program code and hardware, the implementation may take the form of firmware. Each block in the flowcharts or the block diagrams may be implemented using special purpose hardware systems that perform the different operations or combinations of special purpose hardware and program code run by the special purpose hardware.

In some alternative implementations of an illustrative embodiment, the function or functions noted in the blocks may occur out of the order noted in the figures. For example, in some cases, two blocks shown in succession may be performed substantially concurrently, or the blocks may sometimes be performed in the reverse order, depending upon the functionality involved. Also, other blocks may be added, in addition to the illustrated blocks, in a flowchart or block diagram.

Figure 13:
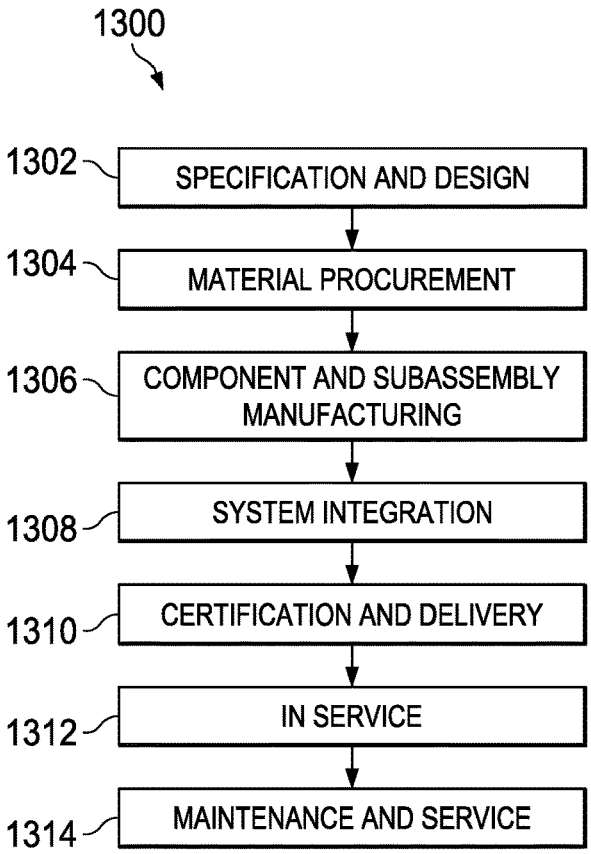
FIG. 13 is an illustration of a block diagram of an aircraft manufacturing and service method in accordance with an illustrative embodiment.
Figure 14:
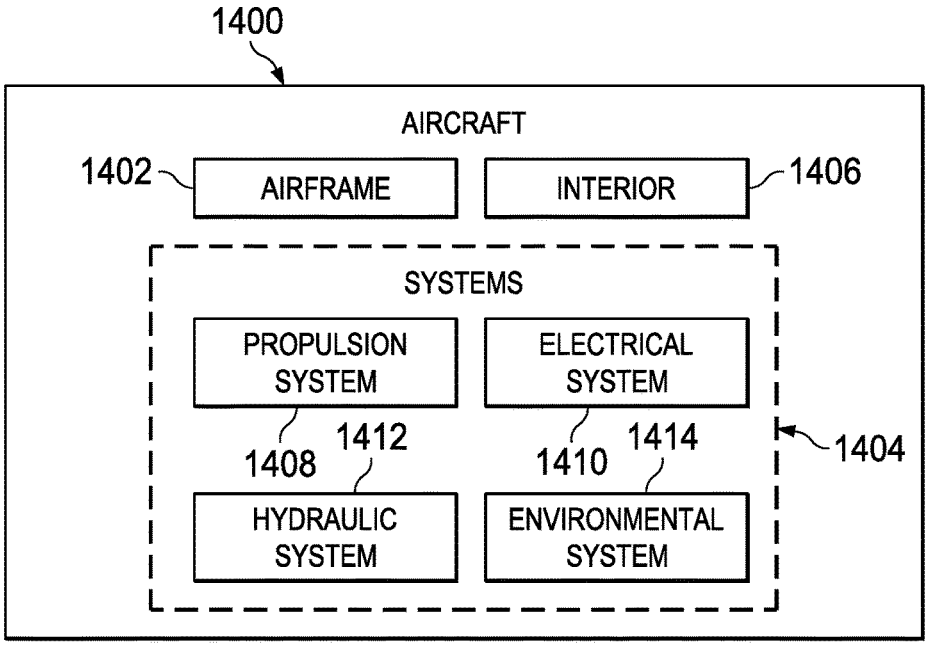
FIG. 14 is an illustration of a block diagram of an aircraft in which an illustrative embodiment may be implemented.

The illustrative embodiments of the present disclosure may be described in the context of aircraft manufacturing and service method 1300 as shown in FIG. 13 and aircraft 1400 as shown in FIG. 14. Turning first to FIG. 13, an illustration of a block diagram of an aircraft manufacturing and service method is depicted in accordance with an illustrative embodiment. During pre-production, aircraft manufacturing and service method 1300 may include specification and design 1302 of aircraft 1400 in FIG. 14 and material procurement 1304.

During production, component and subassembly manufacturing 1306 and system integration 1308 of aircraft 1400 in FIG. 14 takes place. Thereafter, aircraft 1400 in FIG. 14 may go through certification and delivery 1310 in order to be placed in service 1312. While in service 1312 by a customer, aircraft 1400 in FIG. 14 is scheduled for routine maintenance and service 1314, which may include modification, reconfiguration, refurbishment, or other maintenance and service.

Each of the processes of aircraft manufacturing and service method 1300 may be performed or carried out by a system integrator, a third party, an operator, or some combination thereof. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 14, an illustration of a block diagram of an aircraft is depicted in which an illustrative embodiment may be implemented. In this example, aircraft 1400 is produced by aircraft manufacturing and service method 1300 in FIG. 13 and may include airframe 1402 with plurality of systems 1404 and interior 1406. Examples of systems 1404 include one or more of propulsion system 1408, electrical system 1410, hydraulic system 1412, and environmental system 1414. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 1300 in FIG. 13.

In one illustrative example, components or subassemblies produced in component and subassembly manufacturing 1306 in FIG. 13 may be fabricated or manufactured in a manner similar to components or subassemblies produced while aircraft 1400 is in service 1312 in FIG. 13. For example, part forming system 102 in FIG. 1 may be used to form parts having desired shapes from workpieces for use in aircraft 1400. For example, workpieces may be stringers without joggle bends and the parts with desired shapes are the stringers with joggle bends which may be used in use subassemblies for aircraft 1400. For example, stringers with joggle bends may be formed for use on skin panels, fuselage sections, and other parts of aircraft 1400.

As yet another example, one or more apparatus embodiments, method embodiments, or a combination thereof may be utilized during production stages, such as component and subassembly manufacturing 1306 and system integration 1308 in FIG. 13. One or more apparatus embodiments, method embodiments, or a combination thereof may be utilized while aircraft 1400 is in service 1312, during maintenance and service 1314 in FIG. 13, or both. For example, part forming system 102 of FIG. 1 may be used to form stringers with joggle bends for parts or subassemblies that may be used in aircraft 1400 during routine maintenance, modification, reconfiguration, refurbishment, or other maintenance and service.

The use of a number of different illustrative embodiments may substantially expedite the assembly of aircraft 1400, reduce the cost of aircraft 1400, or both expedite the assembly of aircraft 1400 and reduce the cost of aircraft 1400. For example, with part forming system 102 in FIG. 1, parts may be generated with more consistency and quality. The increased consistency and quality may occur as a result of an ability to form the parts using ambient or lower temperatures as compared to current systems for forming parts using presses with dies at elevated temperature.

Figure 15:
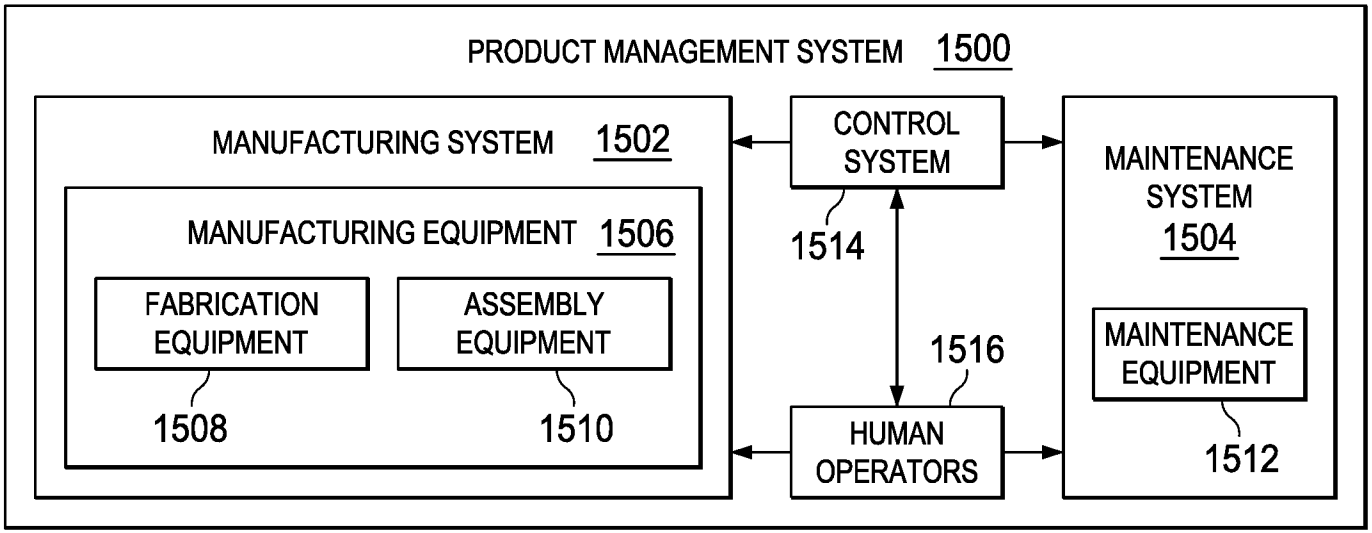
FIG. 15 is an illustration of a block diagram of a product management system in accordance with an illustrative embodiment.

Turning now to FIG. 15, an illustration of a block diagram of a product management system is depicted in accordance with an illustrative embodiment. Product management system 1500 is a physical hardware system. In this illustrative example, product management system 1500 may include at least one of manufacturing system 1502 or maintenance system 1504.

Manufacturing system 1502 is configured to manufacture products, such as aircraft 1400 in FIG. 14. As depicted, manufacturing system 1502 includes manufacturing equipment 1506. Manufacturing equipment 1506 includes at least one of fabrication equipment 1508 or assembly equipment 1510.

Fabrication equipment 1508 is equipment that may be used to fabricate components for parts used to form aircraft 1400 of FIG. 14. For example, fabrication equipment 1508 may include machines and tools. These machines and tools may be at least one of a drill, a hydraulic press, a furnace, a mold, a composite tape laying machine, a vacuum system, a lathe, or other suitable types of equipment.

As depicted, fabrication equipment 1508 may include part forming system 102 in FIG. 1 for use in performing operations on workpieces to form parts with desired shapes. For example, workpieces, such as stringers, may be processed to form stringers with joggle bends. Fabrication equipment 1508 may be used to fabricate at least one of metal parts, composite parts, semiconductors, circuits, fasteners, ribs, skin panels, spars, antennas, or other suitable types of parts.

Assembly equipment 1510 is equipment used to assemble parts to form aircraft 1400 in FIG. 14. In particular, assembly equipment 1510 may be used to assemble components and parts to form aircraft 1400 in FIG. 14. Assembly equipment 1510 also may include machines and tools. These machines and tools may be at least one of a robotic arm, a crawler, a faster installation system, a rail-based drilling system, or a robot. Assembly equipment 1510 may be used to assemble parts such as seats, horizontal stabilizers, wings, engines, engine housings, landing gear systems, and other parts for aircraft 1400 of FIG. 14.

In this illustrative example, maintenance system 1504 includes maintenance equipment 1512. Maintenance equipment 1512 may include any equipment needed to perform maintenance on aircraft 1400 in FIG. 14. Maintenance equipment 1512 may include tools for performing different operations on parts on aircraft. For example, part forming system 102 in FIG. 1 may be found in maintenance equipment 1512 for use in fabricating parts for maintenance operations. These operations may include at least one of disassembling parts, refurbishing parts, inspecting parts, reworking parts, manufacturing replacement parts, or other operations for performing maintenance on aircraft 1400 in FIG. 14. These operations may be for routine maintenance, inspections, upgrades, refurbishment, or other types of maintenance operations.

In the illustrative example, maintenance equipment 1512 may include ultrasonic inspection devices, x-ray imaging systems, vision systems, drills, crawlers, and other suitable device. In some cases, maintenance equipment 1512 may include fabrication equipment 1508, assembly equipment 1510, or both to produce and assemble parts that may be needed for maintenance.

Product management system 1500 also includes control system 1514. Control system 1514 is a hardware system and may also include software or other types of components. Control system 1514 is configured to control the operation of at least one of manufacturing system 1502 or maintenance system 1504. In particular, control system 1514 may control the operation of at least one of fabrication equipment 1508, assembly equipment 1510, or maintenance equipment 1512.

The hardware in control system 1514 may be hardware that may include computers, circuits, networks, and other types of equipment. The control may take the form of direct control of manufacturing equipment 1506. For example, robots, computer-controlled machines, and other equipment may be controlled by control system 1514. In other illustrative examples, control system 1514 may manage operations performed by human operators 1516 in manufacturing or performing maintenance on aircraft 1400 in FIG. 14. For example, control system 1514 may assign tasks, provide instructions, display models, or perform other operations to manage operations performed by human operators 1516.

In the different illustrative examples, human operators 1516 may operate or interact with at least one of manufacturing equipment 1506, maintenance equipment 1512, or control system 1514. This interaction may be performed to manufacture aircraft 1400 in FIG. 14.

Of course, product management system 1500 may be configured to manage other products other than aircraft 1400 in FIG. 14. Although product management system 1500 has been described with respect to manufacturing in the aerospace industry, product management system 1500 may be configured to manage products for other industries. For example, product management system 1500 may be configured to manufacture products for the automotive industry as well as any other suitable industries.

Thus, the illustrative embodiments provide a method and apparatus for manufacturing parts. One or more illustrative examples provide one or more technical solutions that allow for manufacturing parts from workpieces with desired shapes using ambient or lower temperatures as compared to currently available techniques that employ presses with dies at elevated temperatures. For example, one or more illustrative examples provides an ability to produce parts, such as stringers with joggle bends, having increased consistency and quality as compared to the production of these parts using presses and dies with current techniques.

The description of the different illustrative embodiments has been presented for purposes of illustration and description and is not intended to be exhaustive or limited to the embodiments in the form disclosed. The different illustrative examples describe components that perform actions or operations. In an illustrative embodiment, a component may be configured to perform the action or operation described. For example, the component may have a configuration or design for a structure that provides the component an ability to perform the action or operation that is described in the illustrative examples as being performed by the component.

Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A part forming system that comprises:

a die;

a field shaper that comprises a first half and a second half configured to join together and form a cavity configured to receive and retain the die covered by a workpiece, such that each half of the field shaper respectively comprises a relief that comprises a recess from an end of each half toward a center of the field shaper; and a main coil configured to:

generate a magnetic field;

receive the field shaper; and bend, relative to a longitudinal axis, the workpiece to form a part that comprises a desired shape.

2. The part forming system of claim 1 further comprising:

the main coil configured to cause a compressive force on the workpiece on the die to form a stringer.

3. The part forming system of claim 1, wherein the second half comprises a shape that receives the workpiece placed on the die when the first half and the second half are joined to define the cavity.

4. The part forming system of claim 1, further comprising a number of dimensions of the field shaper being based on a size of the main coil.

5. The part forming system of claim 4, wherein the number of dimensions is selected from at least one of a height of the field shaper, a length of the field shaper, a length of a forming area, and a height of the forming area.

6. The part forming system of claim 1, wherein the die is selected from a group of dies consisting of a joggle die, an offset joggle die, and a crush joggle die.

7. The part forming system of claim 1, wherein the magnetic field is an electromagnetic field that causes a magnetic pressure that forms joggle bends in the workpiece for the desired shape of the part.

8. The part forming system of claim 1, wherein the field shaper has a cylindrical shape.

9. The part forming system of claim 1, wherein the die is a joggle die and the part is a stringer for an aircraft.

10. The part forming system of claim 1, wherein the part is selected from one of a stringer, a fuselage stringer, an aircraft stringer, an intercostal, a hydraulic reservoir, a cleat, a duct, a shaped frame, and a shear tie.

11. The part forming system of claim 1, wherein the workpiece comprises at least one of a conductive material, a metal alloy, a nickel alloy, aluminum, steel, carbon steel, copper, brass, silver, iron, or titanium.

12. A part forming system configured to form joggle bends in a workpiece, such that the part forming system comprises:

a joggle die;

a field shaper that comprises a first half and a second half configured to join together and form a cavity configured to receive and retain the joggle die covered by the workpiece, such that each half of the field shaper respectively comprises a relief that comprises a recess from an end of each half toward a center of the field shaper; and a main coil configured to receive the field shaper, such that the main coil comprises:

a number of dimensions that determine a number of dimensions of the field shaper; and an electromagnetic field configured to form, relative to a longitudinal axis, the joggle bends in the workpiece to form a part with a desired shape.

13. The part forming system of claim 12, wherein the second half has a shape that receives the workpiece placed on the joggle die when the first half and the second half are joined to define the cavity.

14. The part forming system of claim 12, wherein the number of dimensions of the field shaper comprises a cross-section that comprises a shape selected from a group that comprises: a circle, a square, a pentagon, an octagon, or an icosagon is selected based on a size of the main coil.

15. The part forming system of claim 12, wherein the joggle die is selected from a group of dies consisting of an offset joggle die and a crush joggle die.

16. A method for forming a part, the method comprising:

placing a workpiece on a die;

producing a field shaper comprising: a first half and a second half, exterior dimensions that fit within a main coil, and each half respectively comprising a relief comprising a recess from an end of each half inward toward a slot in a center of each half, via securing the first half and the second half of the field shaper together and thereby forming a cavity around a center of the field shaper;

placing the die covered by the workpiece into the cavity around the center of the field shaper; and bending, relative to a longitudinal axis, the workpiece onto the die and into a desired shape for the part via a magnetic pressure from applying an electromagnetic field to the field shaper from the main coil located around the field shaper.

17. The method of claim 16 further comprising:

inserting the field shaper with the workpiece in the cavity into the main coil.

18. The method of claim 16, wherein the magnetic pressure is a compressive force on the workpiece that bends the workpiece into the desired shape for the part.

19. The method of claim 16, wherein the magnetic pressure forms joggle bends in the workpiece to form the part.

20. The method of claim 16, wherein the part is selected from one of a stringer, a fuselage stringer, an aircraft stringer, an intercostal, a hydraulic reservoir, a cleat, a duct, a shaped frame, and a shear tie.

* * * * *